US005622195A

United States Patent [19]

Lee

[11] Patent Number: 5,622,195

[45] Date of Patent: Apr. 22, 1997

[54] TRAVELLING TOOTHBRUSH COMBINED WITH RAZOR

[76] Inventor: Jong C. Lee, 251-22, Bukahyun-dong, Seodaemun-ku, Seoul, Rep. of Korea

[21] Appl. No.: 692,976

[22] Filed: Aug. 6, 1996

[30] Foreign Application Priority Data

Aug. 23, 1995 [KR] Rep. of Korea ..... 1995-21940

[51] Int. Cl.[6] ..... A45D 27/24; A46B 15/00

[52] U.S. Cl. ..... 132/289; 30/535; 15/105; 15/184; 132/311; 132/314

[58] Field of Search ..... 132/308, 311, 132/309, 289, 314; 30/535, 41, 125; 15/105, 184

[56] References Cited

U.S. PATENT DOCUMENTS 4,542,828 9/1985 Gotto ..... 132/308
4,612,704 9/1986 Berretti ..... 30/535
4,760,642 8/1988 Kwak ..... 132/289

*Primary Examiner*—Todd E. Manahan
*Assistant Examiner*—Eduardo C. Robert
*Attorney, Agent, or Firm*—David H. Semmes

[57] ABSTRACT

A travelling toothbrush is combined with a razor head disclosed. In the travelling toothbrush with a handle and brush part, a first longitudinal recess is formed on one side of the handle and receives a toothpaste tube therein. A second longitudinal recess is formed on the other side of the handle and receives a disposable razor head therein. The second recess includes a dovetail for holding the razor head therein. A razor head mounting protrusion is provided on the rear portion of the other side of the handle and mounts the razor head to the handle when using the toothbrush as a razor. A handle case is detachably fitted over the handle, while a cap is detachably fitted over the brush part to protect the brush part. The cap has a clip and forms a configuration of a conventional fountain pen in cooperation with the handle case.

3 Claims, 4 Drawing Sheets

TRAVELLING TOOTHBRUSH COMBINED WITH RAZOR

BACKGROUND OF THE INVENTION

1. Field of the Invention

The present invention relates in general to travelling toothbrushes and, more particularly, to a structural improvement in such travelling toothbrushes for giving respective recesses for receiving a toothpaste tube and disposable razor head and means for mounting the razor head to the handle of a toothbrush and thereby selectively using the travelling toothbrush for brushing one's teeth or shaving.

2. Description of the Prior Art

As well known to those skilled in the art, several types of travelling toothbrushes with toothpaste which can be preferably carried by users while travelling on business, tour, camping or climbing have been proposed and used. In typical travelling toothbrushes with toothpaste, the toothpaste is provided in the handle of the toothbrush. That is, a toothpaste tube free from a cap may be received in the handle of the toothbrush and squeezed by an extruder to apply the toothpaste onto the brushes. Alternatively, the toothpaste may be directly contained in the hollow handle of the toothbrush which is also provided with an extruder. The toothpaste contained in the handle of the toothbrush is extruded by the extruder and applied to the brushes prior to using the toothbrush for brushing one's teeth. However, each of the above travelling toothbrushes has a problem in that the toothpaste remains in the paste outlet of the toothbrush handle and is hardened when the toothbrush is not used for a lengthy period of time, so that the toothpaste can not be smoothly extruded when the toothbrush is reused. Another problem of the above travelling toothbrush resides in that the toothpaste may be hardened at the bottom of the brushes and thereby cause the toothbrush to be unsanitary due to the propagation of germs in the brushes.

SUMMARY OF THE INVENTION

It is, therefore, an object of the present invention to provide a travelling toothbrush combined with a razor in which the above problems can be overcome and which has a configuration of a conventional fountain pen and is provided with brushes on its front part, recesses formed on both sides of the toothbrush handle and receiving a paste tube and disposable razor head respectively, and a razor head mounting protrusion on the back of the handle, thus being used for brushing one's teeth or shaving.

In order to accomplish the above object, the present invention provides a travelling toothbrush having a handle and brush part, further comprising: a first longitudinal recess formed on one side of the handle of the toothbrush and adapted for receiving a toothpaste tube therein; a second longitudinal recess formed on the other side of the handle and adapted for receiving a disposable razor head therein, the second recess having means for holding the razor head inside the second recess; a razor head mounting protrusion provided on a rear portion of the other side of the handle and adapted for mounting the razor head to the handle when using the toothbrush as a razor; a handle case detachably fitted over the handle to cover the handle; and a cap detachably fitted over the brush part to protect the brush part, the cap is provided with a clip and forming a configuration of a fountain pen in cooperation with the handle case.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
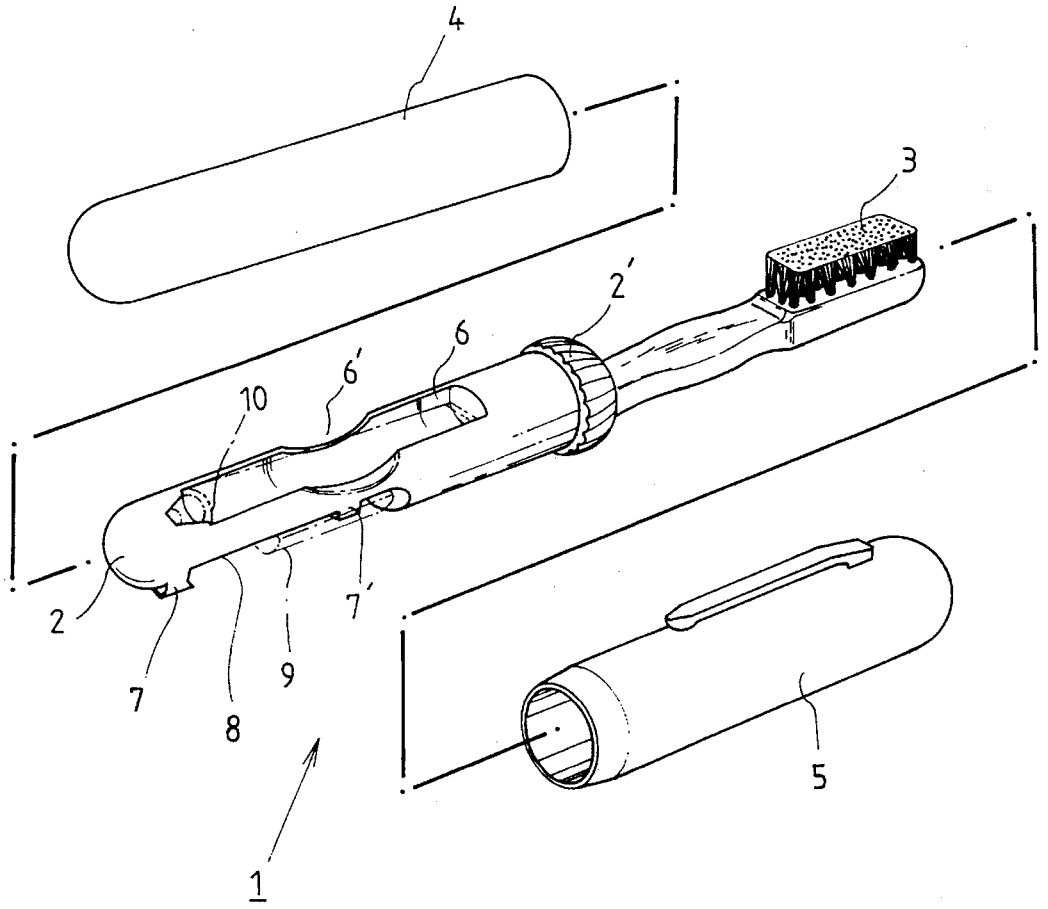
FIG. 1 is an exploded perspective view of a travelling toothbrush combined with a razor in accordance with a primary embodiment of the present invention.
Figure 2:
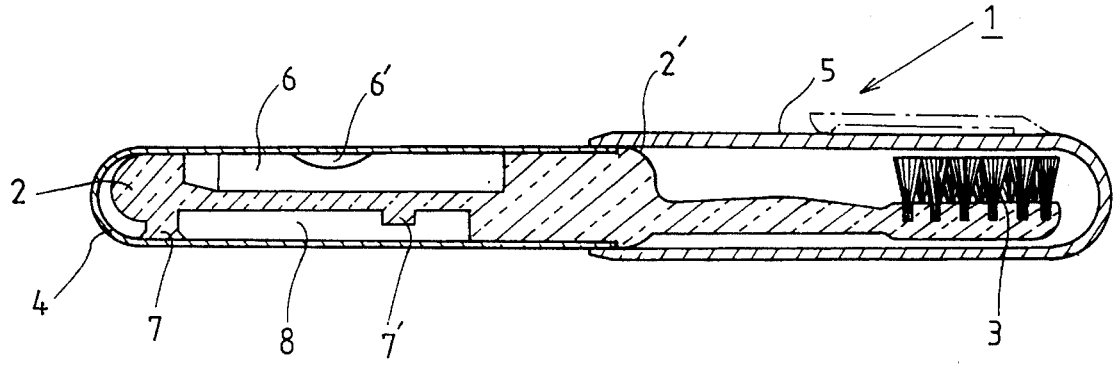
FIG. 2 is a longitudinal sectional view of the assembled toothbrush of this invention.
Figure 3:
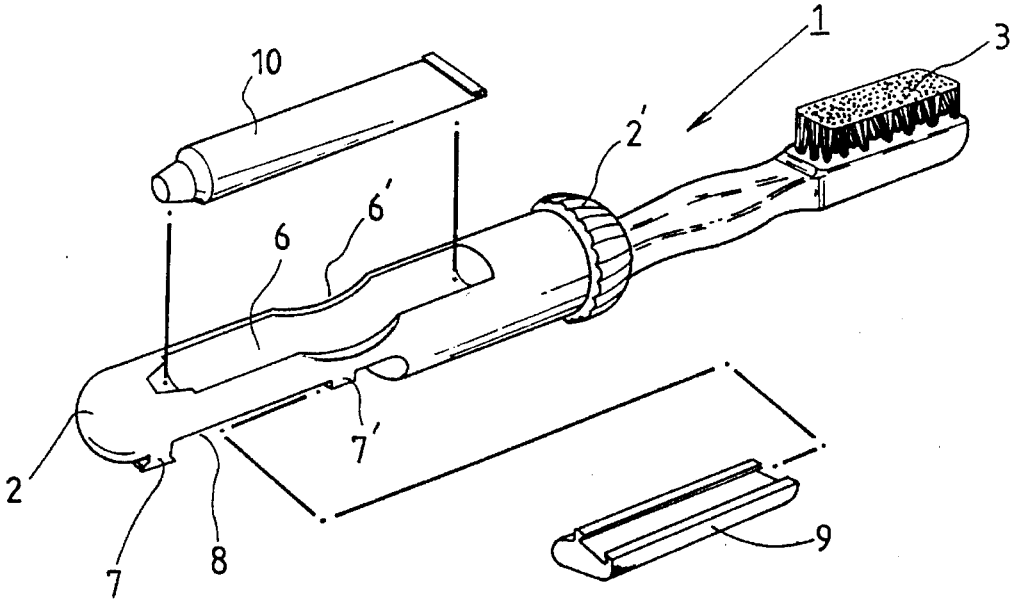
FIG. 3 is a view of the above toothbrush showing a toothpaste tube and disposable razor head received in respective recesses of the toothbrush handle according to this invention.
Figure 4:
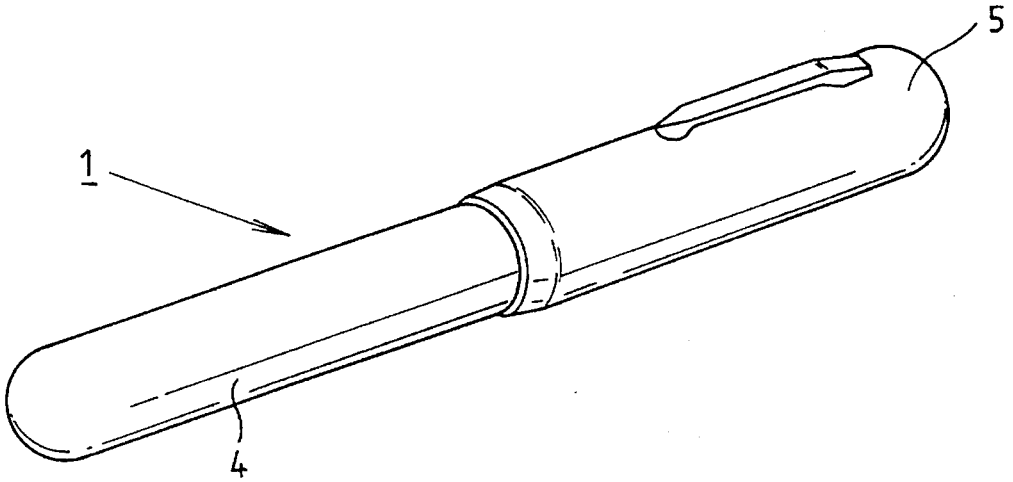
FIG. 4 is a perspective view showing a configuration of the above toothbrush.
Figure 5:
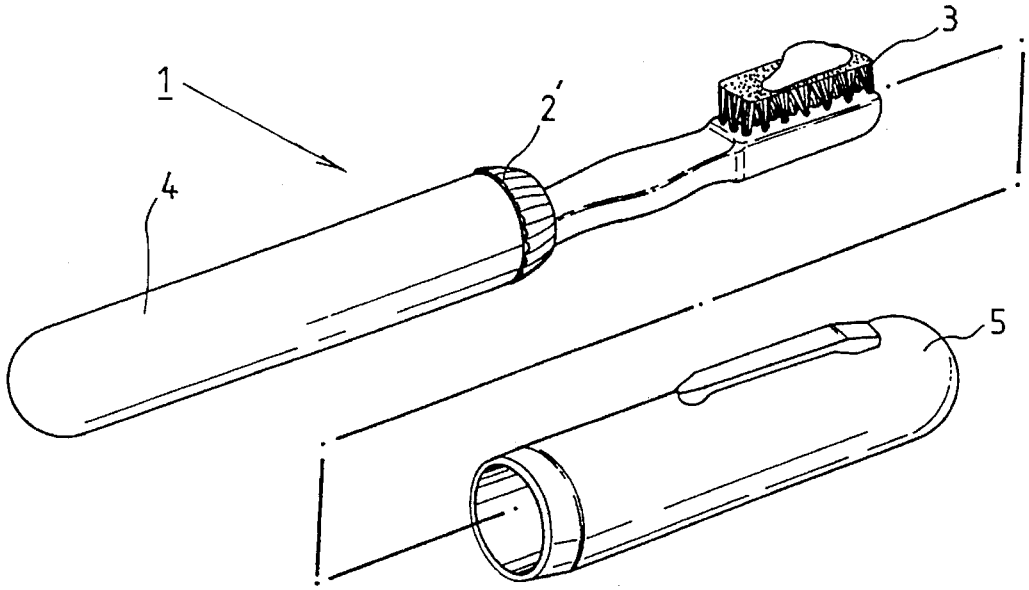
FIG. 5 is a perspective view of the above toothbrush when it is used for brushing one's teeth.
Figure 6:
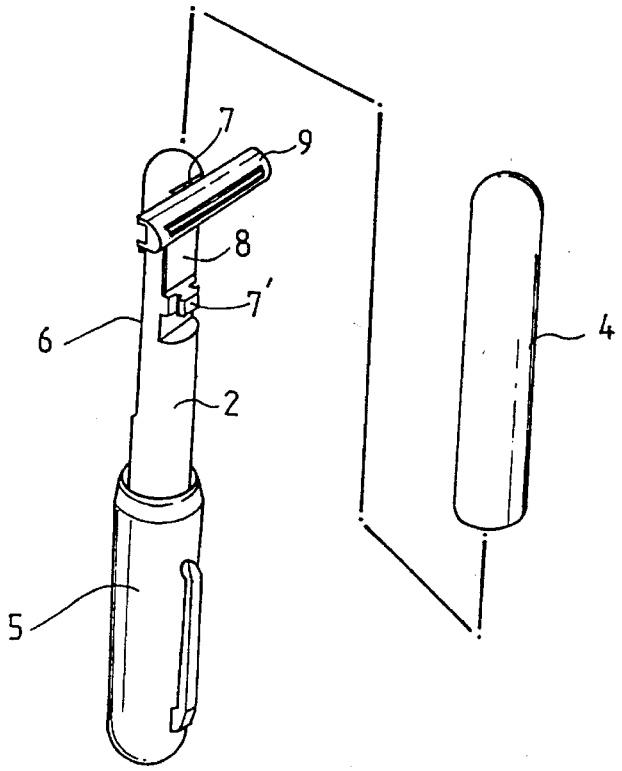
FIG. 6 is a perspective view of the above toothbrush when it is used for shaving.
Figure 7:
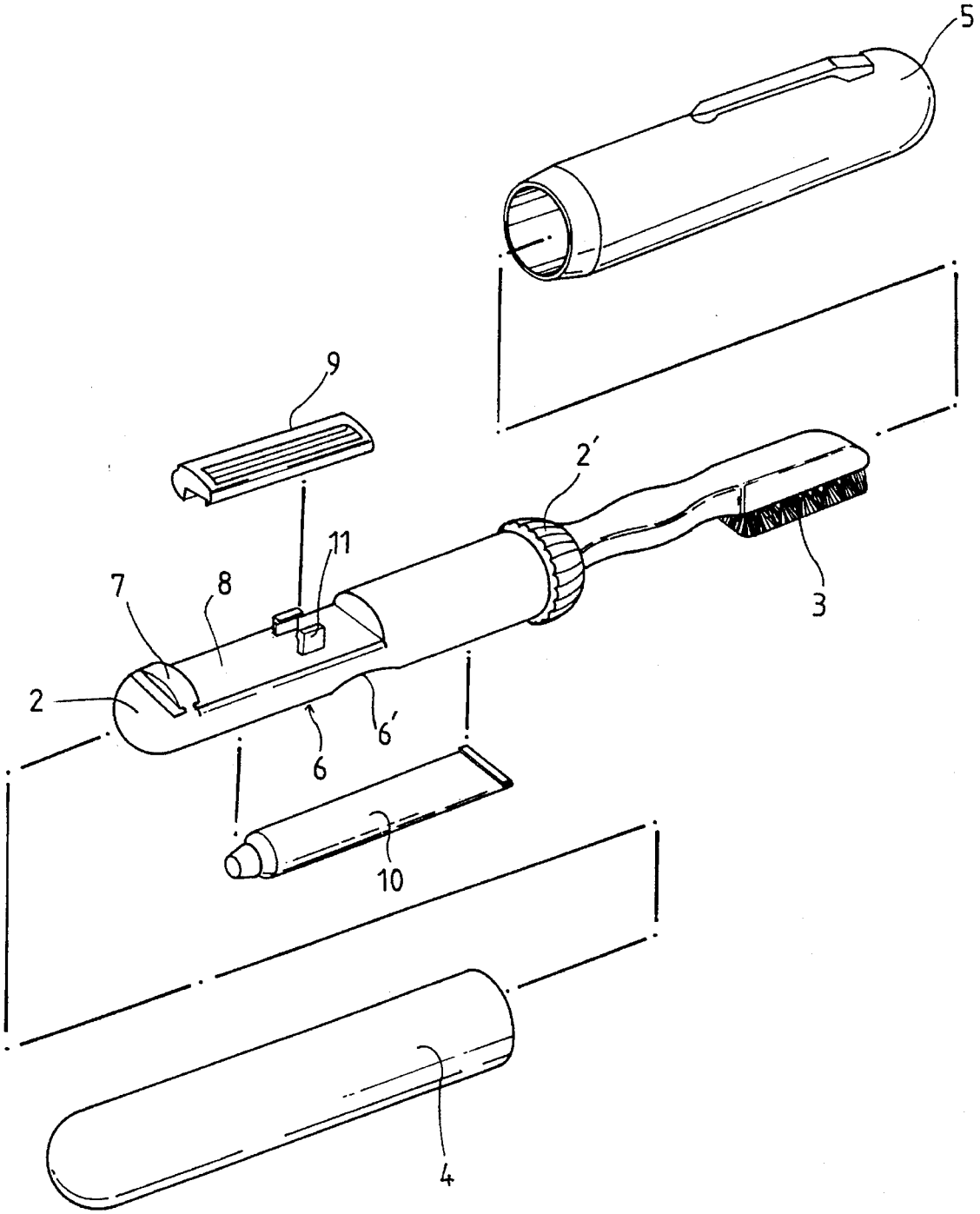
FIG. 7 is an exploded perspective view of a travelling toothbrush having a razor head holding means in accordance with another embodiment of the present invention.

FIGS. 1 to 6 show a toothbrush combined with a razor generally designated at 1 in accordance with a primary embodiment of the present invention. FIG. 7 is an exploded perspective view of a travelling toothbrush having a razor head holding means in accordance with another embodiment of the present invention.

As shown in FIGS. 1 to 6, the toothbrush has brushes and a handle 2 in a conventional manner. The front part with the brushes forms a brush part 3. One side of the above handle 2 has a first longitudinal recess 6 which receives a conventional small-sized toothpaste tube 10 therein.

A razor head mounting protrusion 7 is provided on the rear portion of the other side of the above handle 2 and mounts a disposable razor head 9 to the handle of the toothbrush when the toothbrush is used as a razor. The middle portion of the other side of the handle 2 is longitudinally recessed to form a second longitudinal recess 8 which receives the disposable razor head 9 therein. The above second recess 8 is provided with a razor head holding means which holds the razor head 9 inside the recess 8. In the primary embodiment, the razor head holding means is a single protrusion 7' with a dovetail. The above protrusion 7' engages with the razor head 9 with a dovetail groove. The configuration of the protrusion 7' is shown in FIG. 6. Of course, the razor head holding means may be a pair of elastic snap protrusions 11 which elastically snap and hold the razor head 9 inside the recess 8 as shown in FIG. 7.

A cap 5, which has the configuration similar to the cap of a conventional fountain pen, is detachably fitted over the brush part 3 to protect the brush part 3, while a handle case 4 is detachably fitted over the handle 2 to cover the handle 2 with both the razor head 9 and the toothpaste tube 10. The above cap 5 has a clip. With the above handle case 4 and cap 5 with the clip, the travelling toothbrush of this invention has the configuration of a conventional fountain pen.

In the drawings, the reference numeral 6' denotes rounded notches which is formed on the side walls of the first recess 6 of the handle 2 and allows user's fingers to easily approach the tube 10 inside the recess 6 and thereby facilitates removal of the toothpaste tube 10 from the recess 6. The numeral 2' denotes a toothed ring which is provided on the middle portion of the toothbrush and allows a user to grip the toothbrush body while removing either the handle case 4 or the cap 5 from the toothbrush body.

The operational effect of the above travelling toothbrush will be described hereinbelow.

A user while travelling on business, sightseeing tour, camping or climbing easily carries the above toothbrush clipped on a pocket in a same manner as a conventional fountain pen. In order to brush one's teeth with the above toothbrush, both the handle case 4 and the cap 5 are removed from the toothbrush body prior to separating the toothpaste tube 10 from the first recess 6. After applying the toothpaste onto the brushes of the part 3 by squeezing the tube 10, the tube 10 is received in the recess 6 again prior to fitting the case 4 onto the handle 2. The user brushes one's teeth with the handle case 4 used as a handle of a toothbrush. In this case, the cap 5 is removed from the toothbrush 1 as shown in FIG. 5.

In order to use the above toothbrush as a razor, the case 4 is removed from the handle 2 prior to separating the disposable razor head 9 from the holding means 7' or 11 of the second recess 8. The razor head 9 in turn is mounted to the protrusion 7 of the handle 2 as shown in FIG. 7. In this case, the cap 5 fitted over the brush part 3 is used as a handle of the razor, while the case 4 is removed from the handle 2. The mouth of the cap 5 in the above state is tightly fitted over the toothed ring 2', so that the cap 5 is free from moving while being used as the handle of the razor.

As described above, the present invention provides a travelling toothbrush which is provided with a toothpaste tube and can be selectively used as a razor, thus being convenient to users since the users while travelling on business, tour, camping or climbing do not separately carry toothbrushes, toothpaste tubes and razors. The above toothbrush has a configuration similar to that of a conventional fountain pen with a cap having a clip, so that the toothbrush is clipped on a pocket and easily used for brushing one's teeth or shaving regardless of place.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A travelling toothbrush combined with a razor head, comprising:

a. a handle and brush parts;

b. a first longitudinal recess formed on one side of said handle of the toothbrush and adapted for receiving a toothpaste tube therein;

c. a second longitudinal recess formed on the other side of said handle and adapted for receiving a disposable razor head therein, said second recess having means for holding said razor head inside the second recess;

d. a razor head mounting protrusion provided on a rear portion of the other side of said handle and adapted for mounting said razor head to said handle when using the toothbrush as a razor;

e. a handle case detachably fitted over said handle to cover the handle;

f. a cap detachably fitted over said brush part to protect the brush part, said cap being provided with a clip and forming a configuration of a fountain pen in cooperation with said handle case; and g. a razor head detachably mounted on said razor head mounting protrusion and within said second longitudinal recess, said razor head including a dovetail groove engageable with said razor head mounting protrusion.

2. The travelling toothbrush according to claim 1, wherein said razor head mounting protrusion includes a dovetail suitable to engage complementally with the razor head having a dovetail groove and thereby hold the razor head inside the second recess.

3. The travelling toothbrush according to claim 1, wherein said razor head mounting protrusion includes a pair of snap protrusions elastically snapping and holding said razor head inside the second recess.

* * * * *